United States Patent [19]

Dutcher

[11] 4,407,409

[45] Oct. 4, 1983

[54] CARTON WITH SUSPENSION SUPPORT AND BLANK FOR FORMING SAME

[75] Inventor: Daniel P. Dutcher, Woodbury, Minn.

[73] Assignee: Champion International Corporation, Stamford, Conn.

[21] Appl. No.: 361,530

[22] Filed: Mar. 23, 1982

Related U.S. Application Data

[63] Continuation of Ser. No. 150,729, May 19, 1980, abandoned.

[51] Int. Cl.[3] ..... B65D 25/00

[52] U.S. Cl. ..... 206/45.31; 206/476; 206/583

[58] Field of Search ..... 206/476, 459, 45.31, 206/583; 215/316

[56] References Cited

U.S. PATENT DOCUMENTS

| | | | |
|---|---|---|---|
| 1,920,396 | 8/1933 | Johnson | 215/316 |
| 3,059,830 | 10/1962 | Kramer | 206/583 |
| 3,547,256 | 12/1970 | Bolding | 206/459 |
| 3,675,763 | 7/1972 | Sandel | 206/387 |
| 4,214,659 | 7/1980 | Jaeschke et al. | 206/476 |

FOREIGN PATENT DOCUMENTS

| | | | |
|---|---|---|---|
| 326820 | 2/1958 | Switzerland | 206/583 |

*Primary Examiner*—Joseph Man-Fu Moy

*Attorney, Agent, or Firm*—Evelyn M. Sommer; John H. Mulholland; William W. Jones

[57] ABSTRACT

A carton for suspending an article within the carton and a blank for forming same has a collapsible arrangement for automatically forming the suspension support. This arrangement includes two parallel bridge panels, each of which is hingedly coupled at its opposite side edges to the front and back panels at locations spaced from the side panels of the carton. The upper edges of the bridge panels form a support surface which is substantially perpendicular and between the carton panels for supporting an edge of a cap of an article to suspend the article between the bridge panels and within the carton. Front flaps pivotedly mounted at the opposite side edges of the front panel may be formed in the front panel and located behind the cap of the article to create a shadow effect.

1 Claim, 8 Drawing Figures

CARTON WITH SUSPENSION SUPPORT AND BLANK FOR FORMING SAME

This is a continuation of application Ser. No. 150,729, filed May 19, 1980 now abandoned.

BACKGROUND OF THE INVENTION

1. Field of the Invention

The present invention relates to a carton having an arrangement for suspending an article within the carton, and a blank for forming the carton. More particularly, the invention relates to a collapsible support arrangement which forms a support surface within the carton that is spaced from the ends and substantially perpendicular to the front, back and side panels of the carton on which surface an article may be suspended above the carton bottom.

2. Description of the Prior Art

In constructing cartons or containers for certain articles, e.g., those having a breakable container, it is necessary to protect the article from forces exerted on the carton. Additionally, the carton should aesthetically display the article while being easy to form and pack. The carton should also adequately support the load placed upon it by the article contained therein.

Conventional cartons employ dividers to separate the carton interior into a middle article receiving compartment with empty shock absorbing compartments on either side thereof. U.S. Pat. No. 3,158,259 to Pantalone discloses a protective display carton having an interior divided into three compartments. The side compartments are left empty to cushion the article. The center compartment locates and retains the article which rests on the bottom closure of the carton. The top edges of the divider panels are slanted relative to the front and back panels of the carton to receive an angled top member. Openings are provided in one of the carton panels to permit viewing of the article contained therein.

SUMMARY OF THE INVENTION

Since the carton manufacturer may be located far from where the articles are packed within the carton, the carton must be capable of being shipped and stored in a flat, collapsed configuration to use shipping and storage space efficiently. Otherwise, the carton would waste considerable space and prevent economical shipment and storage.

Once at the packing location, the partialy assembled carton must be capable of being fully assembled easily without the use of skilled personnel or complex machinery. Thus, the action necessary to convert the carton from its fully assembled, collapsed configuration to its fully assembled state must be extremely quick and simple. Additionally, the carton so formed must be capable of supporting considerable weight without collapsing and present an attractive appearance for display.

Accordingly, an object of the present invention is to provide a carton and a blank for forming a carton with means for suspending the article within the carton.

Another object of the present invention is to provide a carton and a blank for forming a carton for supporting an article which is collapsible for shipment and storage in a flat, partially assembled, collapsed configuration and which may be simply and quickly converted to a fully assembled configuration.

An additional object of the present invention is to provide a carton with a collapsible arrangement for automatically forming an article supporting arrangement which fully supports the articles within the carton.

A further object of the present invention is to provide a carton and a blank for forming a carton having a collapsible article suspension arrangement which is of rugged construction and which is simple and inexpensive to manufacture, assemble and use.

The foregoing objects are attained by providing a carton for suspending an article therein, comprising a front panel, first and second side panels hingedly coupled at opposite side edges of the front panel along fold lines, a back panel hingedly coupled at opposite side edges thereof to side edges of the first and second side panels remote from the front panel along fold lines, top and bottom cover means coupled to top and bottom edges, respectively, of the panels, and collapsible support means for providing a support surface substantially perpendicular to and between the panels for supporting an article, the support means comprising first and second parallel bridge panels having upper edges forming the support surface, each bridge panel hingedly coupled at opposite side edges thereof to the front and back panels at locations spaced from the side panels.

The foregoing objects are also attained by a planar unitary blank for forming a carton comprising a front panel, first and second side panels hingedly coupled at opposite side edges of the front panel along fold lines, a back panel hingedly coupled to the second side panel at a side edge thereof remote from the front panel along a fold line, a first glue flap hingedly coupled to the first side panel at a side edge thereof remote from the front panel along a fold line, and support panels hingedly coupled to the first glue flap at a side edge thereof remote from the side panel along a fold line, the support panels including a base panel, first and second bridge panels hingedly coupled to opposite side edges of the base panel along fold lines, the second bridge panel being coupled at a side edge thereof remote from the base panel to the first glue flap, top edges of the bridge panel being located between top and bottom edges of the front, back and side panels and being substantially perpendicular to the fold lines between the front, back and side panels, and a glue flap hingedly coupled to the first bridge panel at a side edge thereof remote from the base panel along a fold line.

By forming the carton and the blank of the present invention in this manner, a carton may be provided which may be partially formed and shipped in a flat, collapsed configuration then easily and quickly rearranged to a fully assembled configuration in which the carton has a support arrangement to suspend an article within the carton spaced from the top and bottom cover arrangements. This enables the article to be more securely supported without hindering opening of the top and bottom cover arrangements and without complicating packing of the article within the carton. Additionally, an attractive display is provided for the article.

Flaps may be formed in the front panel which may be folded behind the cap of the article suspended in the carton. This will give a shadow effect to the article, thereby enhancing the visual display of the article.

Other objects, advantages and salient features of the present invention will become apparent from the following detailed description, which taken in conjunction with the annexed drawings, discloses a preferred embodiment of the present invention.

As used in this application, the terms "first", "second", "front", "back", "side", "top" and "bottom" are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
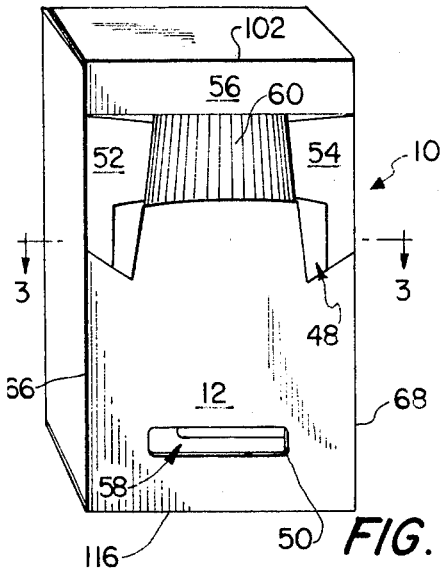
FIG. 1 is a perspective view illustrating the carton of the present invention in its fully assembled configuration with an article placed therein.
Figure 2:
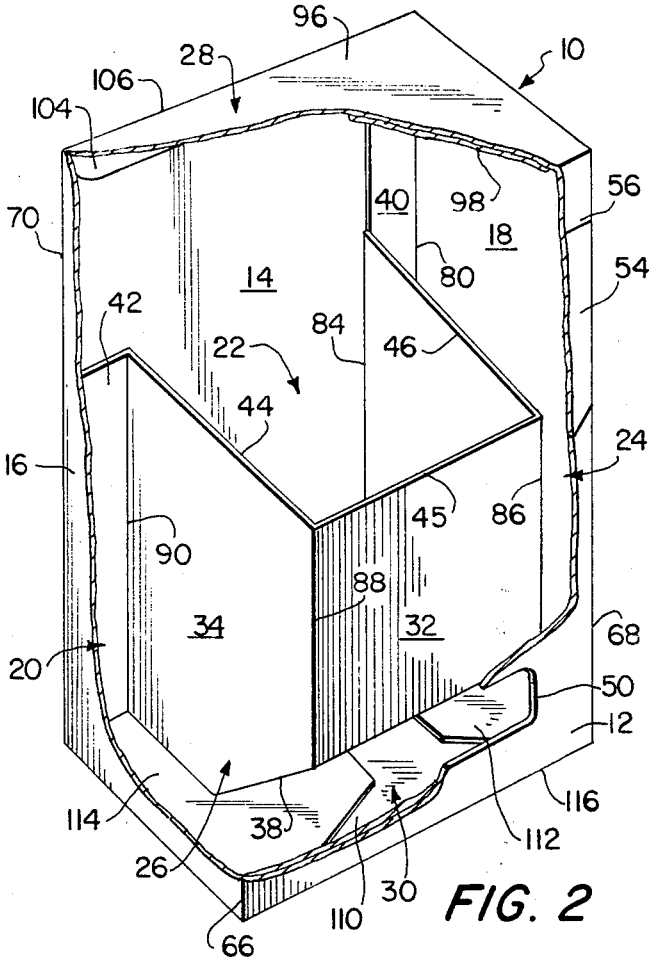
FIG. 2 is a perspective view, partially sectioned, illustrating the carton of FIG. 1 without the article.
Figure 3:
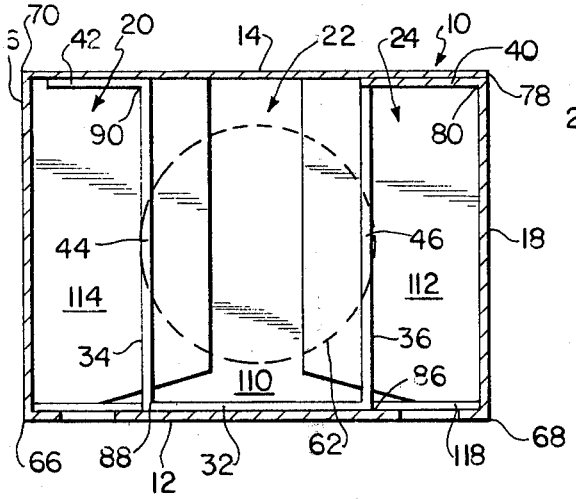
FIG. 3 is a top view, in cross section, of the carton of FIG. 1 taken along lines 3—3 of FIG. 1 without the article.

Referring to FIGS. 1–3, the carton 10 in its assembled configuration has a front panel 12, a back panel 14 and first and second side panels 16, 18. The front and back panels 12, 14 are opposed and parallel. The side panels 16, 18 are opposed and parallel to each other and are perpendicular to the front and back panels 12, 14. These panels are hingedly coupled along adjacent side edges to form a tube of rectangular cross section.

The interior of the carton 10 is divided into three compartments 20, 22, 24 by a collapsible support arrangement 26. The center compartment is for receiving the article, while the side compartments 20, 24 are left empty to cushion the article.

A top cover arrangement 28 and a bottom cover arrangement 30 of generally conventional construction close the ends of the carton. The details of these arrangements will be discussed in greater detail hereinafter.

The support arrangement 26 comprises a generally U-shaped member with a base panel 32 parallel to front and back panels 12, 14 and with first and second bridge panels 34, 36 parallel to side panels 16, 18 and perpendicular to panels 12, 14. The base panel 32 is rectangular. The bridge panels 34, 36 are hingedly coupled to opposite side edges of the base panel 32 and are generally rectangular in shape with the lower corners thereof chamfered at 38. The base panel 32 is shorter than the bridge panels 34, 36.

The support arrangement 26 is secured within the carton interior by the base panel 32 and by first and second glue flaps 40, 42. The base panel 32 is fixedly secured to the interior surface of the front panel 12 to couple hingedly the front edges of the bridge panels 34, 36 to the front panel 12. The glue flaps 40, 42 hingedly couple the back edges of the bridge panels 34, 36 to the back panel 14 as well as space the bridge panels 34, 36 from the side panels 16, 18, respectively. The first glue flap 40 also hingedly couples the back panel 14 and the first side panel 16.

The upper edges 44, 46 of the bridge panels 34, 36, respectively, form a support surface perpendicular to and between the panels 12, 14, 16, 18 for suspending an article within the carton. The edges 44, 46 are spaced from the top and bottom ends of the panels 12, 14, 16, 18 to provide adequate space for the article with spaces above and below the article for cushioning.

The front panel 12, as illustrated in FIG. 1, has upper and lower openings 48, 50. The lower opening is elongated in a horizontal direction and is located adjacent the bottom end of the front panel 12. The upper opening 48 is located adjacent the upper end of the front panel 12 and is generally above the support arrangement 26.

The upper opening 48 is formed by first and second front flaps 52, 54 which are formed in the front panel 12 above the support arrangement 26. The front flaps 52, 54 are hingedly coupled at opposite side edges of the front panel 12 and are defined by slits formed in the front panel 12. The flaps 52, 54 are spaced downwardly from the top end of the carton to form a header panel 56 coplanar with the front panel 12.

An article 58 with a cap 60 is inserted within the carton 10 from the top. An edge 62 of the cap 60 is placed on the support surface of the support arrangement 26 formed by the upper edges 44, 46 of the panels 34, 36, respectively. The remainder of the article 58 is guided and located between the bridge panels 34, 36 within the central compartment 22 of the carton 10. When the edge 62 rests on the edges 44, 46, the bottom of the article 58 is suspended above the bottom cover arrangement 30 so that the article is fully supported by the bridge panels 34, 36 and cushioning spaces are provided above and below the article 58 without providing additional platforms. The bottom of the article 58 is exposed for viewing through the lower opening 50. The front panel 12 between the openings 48, 50 is left intact for advertising and to cover the indicia on the article itself. By covering the article 58 in this manner, there is no need to place the article 58 within the carton in any specific orientation.

The orientation of the bridge panels 34, 36 in vertical planes (i.e., parallel to the side panel 16, 18) permits the weight of the article 58 bearing on edges 44, 46 to be supported by the entire height of the panels 34, 36, not solely by their thicknesses. This enables the support arrangement 26 to support relatively large weights without providing bottom support platforms.

Prior to insertion of the article 58 within the carton 10, the front flaps 52, 54 are folded into the interior of the carton. After the article 58 has been placed within the carton with the edge 62 of the cap 60 resting on the edges 44, 46 of the panels 34, 36, the front flaps 52, 54 are released to abut against the cap 60. This arrangement of the flaps 52, 54 (illustrated in FIG. 1) gives an attractive shadow effect which enhances the display appearance of the carton and article.

Figure 4:
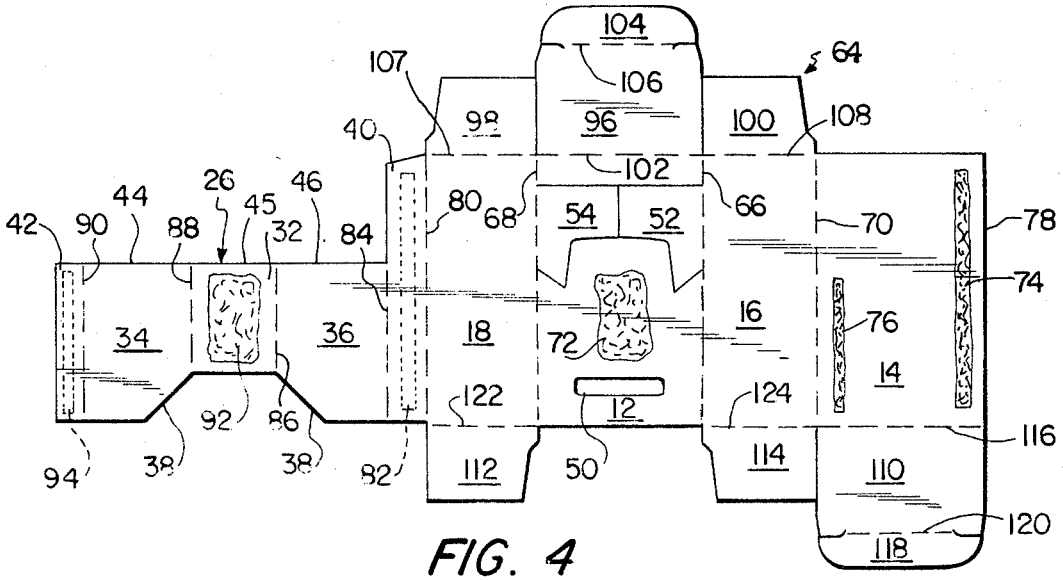
FIG. 4 is a plan view illustrating the interior surface of a blank for forming the carton of FIG. 1.

The carton 10 is formed from the planar unitary blank 64 illustrated in FIG. 4. The blank 64 may be formed of a unitary piece of paperboard of suitable weight and thickness. The weight and thickness of the paperboard depends on the size and weight of the article 58 contained within the carton 10. FIG. 4 illustrates the surface of the blank 64 which will form the interior surface of the carton 10 illustrated in FIGS. 1–3.

The main portion of the blank 64 comprises the front panel 12, the back panel 14 and the side panels 16, 18.

Each of these panels is generally rectangular in shape. The side panels 16, 18 are hingedly coupled at opposite side edges of the front panel 12 along fold lines 66, 68, respectively. The back panel 14 is hingedly coupled to the side panel 16 at a side edge thereof remote from the front panel 12 along a fold line 70.

The front panel 12 has a glue area 72 located on its interior surface intermediate the fold lines 66, 68 and intermediate the flaps 52, 54 and the opening 50. The back panel 14 has elongated glue areas 74, 76 on its interior surface. The glue area 74 is located adjacent, but spaced from, the free side edge 78, while the relatively shorter glue area 76 is located adjacent, but spaced from, the fold line 70.

The first glue flap 40 is in the form of a right trapezoid with its longer parallel base hingedly coupled to the side panel 18 at a side edge thereof remote from the front panel 12 along a fold line 80. A glue area 82 oriented and shaped to mate with the glue area 74 is provided on the exterior surface of the glue flap 40.

The support arrangement 26 is hingedly coupled to the smaller parallel base (i.e., the edge remote from the side panel 18) of the trapezoidal glue flap 40 along fold line 84. The bridge panels 36, 34 are hingedly coupled to opposite side edges of the base panel 32 along fold lines 86, 88, respectively. The bridge panel 36 is hingedly coupled at its side edge remote from the base panel 32 to the first glue flap 40. The upper edges 44, 45, 46 of the panels 34, 32, 36, respectively, are located between the top and bottom edges of the panels 12, 14, 16, 18 and are substantially perpendicular to the fold lines 66, 68, 70 located between such panels. As illustrated in FIG. 4, the upper edges 44, 45, 46 are colinear. The second glue flap 42 is hingedly coupled to the bridge panel 34 at its side edge remote from the base panel 32 along fold line 90. The glue flap 42 is rectangular and equal in height to the bridge panels 32, 34.

The base panel 32 has a glue area 92 on the surface thereof exposed in FIG. 4 which is shaped and oriented to mate with the glue area 72 on the front panel 12. The glue flap 42 has a glue area 94 shaped and oriented to mate with the glue area 76 on the back panel 14.

The top cover arrangement 28 is located along the top edges of the front panel 12 and the side panels 16, 18 and comprises a top cover panel 96 and two top flaps 98, 100. The top cover panel 96 is rectangular and is hingedly coupled to the front panel 12 along a fold line 102. A tuck flap 104 is hingedly coupled to the end edge of the top cover panel 96 remote from the front panel 12 along a fold line 106 having slits at the longitudinal ends thereof. The top flaps 98, 100 are of conventional shape and are hingedly coupled to the side panels 18, 16 along fold lines 107, 108, respectively.

The bottom cover arrangement 30 comprises a bottom cover panel 110 and two bottom flaps 112, 114. The bottom cover panel 110 is rectangular and is hingedly coupled to the bottom end edge of the back panel 14 along a fold line 116. A tuck flap 118 is hingedly coupled to the bottom cover panel 110 along its end edge remote from the back panel 14 along a fold line 120 having slits at its longitudinal ends. The bottom flaps 112, 114 are of conventional shape and are hingedly coupled to the bottom end edges of the side panels 18, 16 along fold lines 122, 124, respectively.

Figure 5:
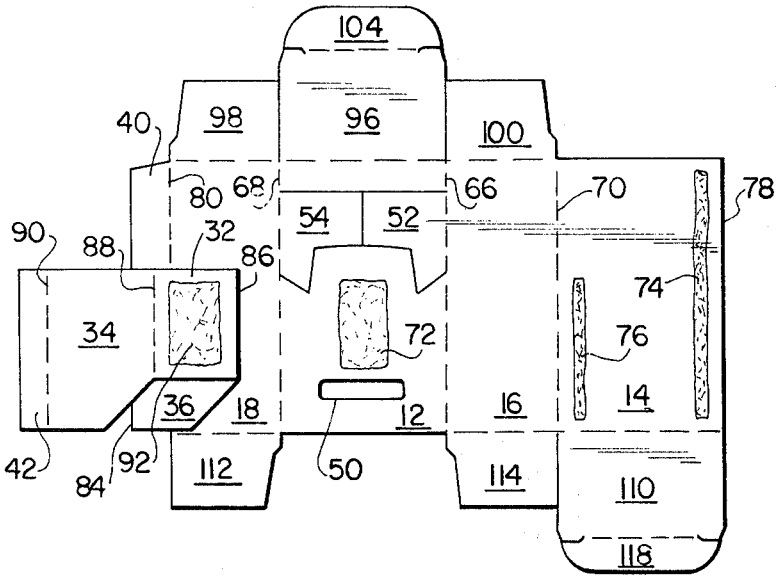
FIGS. 5 and 6 are plan views illustrating the blank of FIG. 1 in various stages of folding and gluing.

The carton 10 is formed from the blank 64 of FIG. 4 by folding the base panel 32 about fold line 86 and by folding the bridge panel 36 about fold line 84 to the configuration illustrated in FIG. 5. In the FIG. 5 configuration, bridge panel 34 and glue flap 42 remain coplanar with the base panel 32, bridge panel 36 overlies the interior surface of side panel 18 and base panel 32 overlies bridge panel 36.

Figure 6:
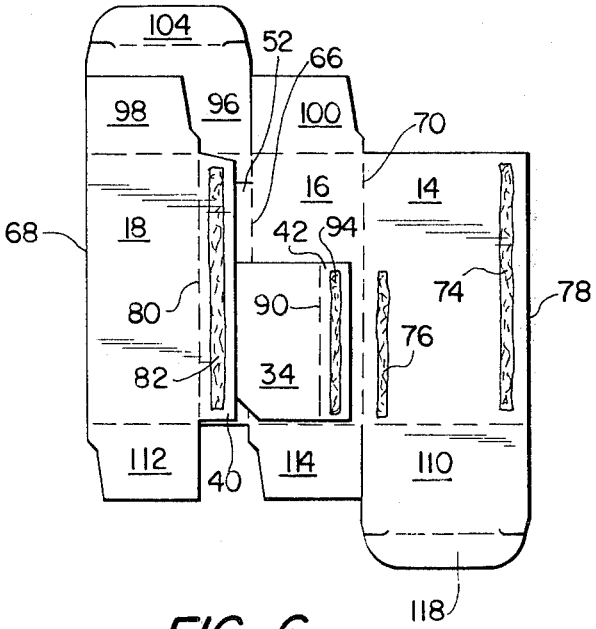

Thereafter, side panel 18, along with panels 32, 34, 36 and flaps 40, 42, 98, 112, are folded about fold line 68 to the position illustrated in FIG. 6. In the FIG. 6 position, side panel 18 and base panel 32 overlie the interior surface of the front panel 12, the bridge panel 34 and the glue flap 40 overlie the side panel 16, and the glue areas 92 and 72 mate. The adhesive applied to the glue area 92 and/or glue area 72 fixes the base panel 32 to the interior surface of the front panel 12. Additionally, the glue area 82 on the glue flap 40 and the glue area 94 on the glue flap 42 are exposed.

Figure 7:
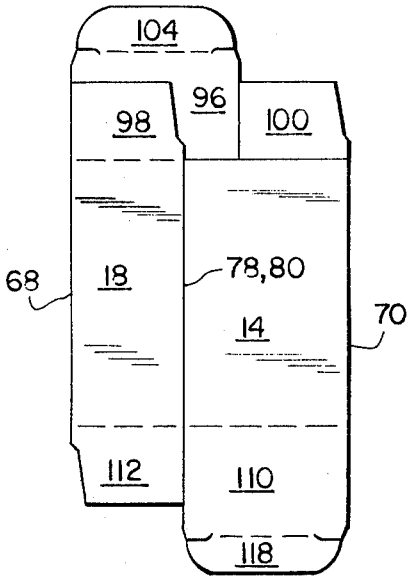
FIG. 7 is a top plan view illustrating the blank of FIG. 4 after it has been folded and glued to a partially assembled, collapsed configuration of the carton of FIG. 1.

Once the blank is in the configuration illustrated in FIG. 6, the back panel 14 is folded about fold line 70 to overlie the glue flap 40, the bridge panel 34 and the glue flap 42 as illustrated in FIG. 7. In this position, the glue areas 94, 76 mate and the glue areas 82, 74 mate. The adhesive applied to glue area 94 and/or glue area 76 fixes the glue flap 42 to the interior surface of the back panel 14 to hingedly coupled the bridge panel 34 to the back panel 14 along the fold line 90. Similarly, the adhesive applied to glue area 82 and/or glue area 74 affixes the glue flap 40 to the interior surface of the back panel 14 to hingedly couple the side panel 18 and the bridge panel 36 to the back panel 14 along the fold lines 80, 84, respectively. When the back panel 14 is folded, the free side edge 78 of the back panel 14 overlies the fold line 80.

Figure 8:
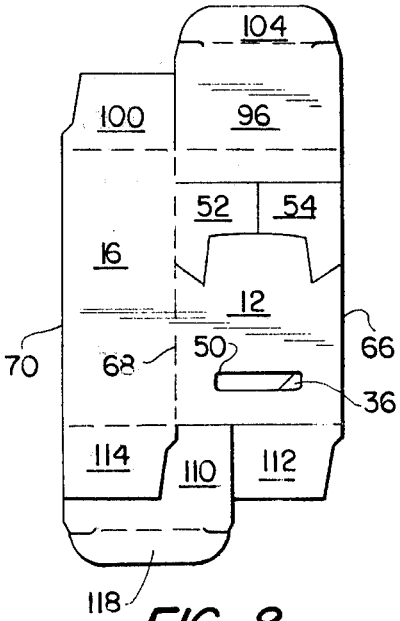
FIG. 8 is a bottom plan view of the carton of FIG. 7.

The blank 64 is now in the configuration illustrated in FIGS. 7 and 8. This configuration represents a partially assembled, flat, collapsed configuration of the carton 10 in which it may be shipped, stored and fully assembled simply, inexpensively and efficiently. FIG. 7 is a top plan view of the collapsed configuration of the carton 10, while FIG. 8 is a bottom plan view of the collapsed configuration of the carton 10.

The fully assembled configuration of FIGS. 1–3 is achieved from the partially assembled collapsed configuration of FIGS. 7 and 8 by applying opposing forces against the side edges (i.e., fold lines 68, 70) of the collapsed configuration of the carton. These forces cause the carton to open up or expand with the panels 12, 14, 16, 18 pivoting about fold lines 66, 68, 70, 80 away from their collapsed position towards a position in which the front and back panels 12, 14 are opposed and parallel, and the side panels 16, 18 are opposed and parallel to each other and perpendicular to the front and back panels 12, 14. As the panels 12, 14, 16, 18 are pivoting towards their fully assembled position to form the side walls of the carton 10, the bridge panels 34, 36 automatically and simultaneously pivot about fold lines 88, 90 and fold lines 84, 86, respectively, into their assembled orientation to divide the interior of the carton into the three compartments 20, 22, 24 and to form the support surface (i.e., edges 44, 46). Once the panels 12, 14, 16, 18, 34, 36 have assumed their fully assembled configuration, the article 56 may be inserted through the top of the carton 10 with the edge 62 of the cap 60 rested on the edges 44, 46, and the top and bottom closure arrangements 28, 30 closed in conventional fashion.

By forming and folding the carton in this manner, the weight of the article 58 is borne by the relatively sturdy support arrangement 26 which is held in place by adhesive, rather than by the bottom closure arrangement 30 which is retained in place solely by the frictional engagement of the tuck flap 118 between the bottom flaps 112, 114 and the front panel 12. This also provides a simple mechanism for forming a support for the article spaced from the ends of the carton without having to provide additional platforms for the article.

The appearance of the article is enhanced by the provision of the front flaps 52, 54 which provide a simple and inexpensive, yet effective mechanism for providing an attractive shadow effect.

While providing these support and display enhancement features, the carton 10 of the present invention is still capable of being shipped and stored in a substantially flat, collapsed configuration and then easily and simply formed into a fully assembled carton by a simple operation without the use of glue.

While a particular embodiment has been chosen to illustrate the invention, it will be understood by those skilled in this art that various changes and modifications can be made therein without departing from the scope of the invention as defined in the appended claims.

What is claimed is:

1. A carton for suspending a capped breakable container therein, the cap having a laterally extending skirt extending outwardly of the container portion below and immediately adjacent thereto, said carton comprising:

a front panel;

first and second side panels hingedly coupled at opposite side edges of said front panel along fold lines;

top and bottom cover means coupled to top and bottom edges, respectively, of said panels; and collapsible support means for providing a support surface intermediate said top and bottom cover means substantially perpendicular to and between said front and back panels for supporting said container on the bottom edge of its cap with the bottom of the container spaced above said bottom cover means;

said support means comprising first and second parallel bridge panels having upper edges forming said support surface, each of said bridge panels being a leg of a U-shaped member having a base panel fixed to said front panel;

said legs being hingedly coupled to opposite side edges of said base panel along fold lines and secured to said back panel by means of glue flaps hingedly coupled to side edges of said legs remote from said base panel;

first and second front flaps formed in said front panel above said support means for forming an opening in said front panel;

said front flaps being hingedly coupled at opposite side edges of said front panel and defined by slits formed in said front panel to permit said front flaps to be folded into the interior of the carton and behind the container cap at an angle of inclination with respect to said back panel.

* * * * *